US009694404B2

(12) United States Patent
Clocchiatti et al.

(10) Patent No.: US 9,694,404 B2
(45) Date of Patent: Jul. 4, 2017

(54) STRAIGHTENING DEVICE WITH HYPERBOLIC ROLLS FOR METAL PRODUCTS AND CORRESPONDING METHOD

(75) Inventors: Loris Clocchiatti, Magnano in Riviera (IT); Simone Antonio Migali, Udine (IT)

(73) Assignee: DANIELI & C. OFFICINE MECCANICHE SPA, Buttrio (IT)

( * ) Notice: Subject to any disclaimer, the term of this patent is extended or adjusted under 35 U.S.C. 154(b) by 376 days.

(21) Appl. No.: 14/131,998

(22) PCT Filed: Jul. 10, 2012

(86) PCT No.: PCT/IB2012/001356
§ 371 (c)(1),
(2), (4) Date: May 28, 2014

(87) PCT Pub. No.: WO2013/008081
PCT Pub. Date: Jan. 17, 2013

(65) Prior Publication Data

US 2014/0318202 A1 Oct. 30, 2014

(30) Foreign Application Priority Data

Jul. 11, 2011 (IT) ..... UD2011A0108

(51) Int. Cl.
*B21B 37/62* (2006.01)
*B21D 3/02* (2006.01)
(Continued)

(52) U.S. Cl.
CPC ..... *B21B 37/62* (2013.01); *B21D 3/02* (2013.01); *B21D 55/00* (2013.01); *B21B 31/32* (2013.01)

(58) Field of Classification Search
CPC ... B21D 3/02; B21D 3/04; B21D 3/05; B21D 55/00; B21B 13/008; B21B 13/103;
(Continued)

(56) References Cited

U.S. PATENT DOCUMENTS 3,693,385 A * 9/1972 Fujino ..... B21B 37/62 72/10.6
3,858,425 A 1/1975 Thompson
(Continued)

FOREIGN PATENT DOCUMENTS

DE 19724300 12/1998

OTHER PUBLICATIONS

International Search Report and Written Opinion from PCT/IB2012/001356 dated Nov. 9, 2012.
(Continued)

*Primary Examiner* — Peter DungBa Vo
*Assistant Examiner* — Joshua D Anderson
(74) *Attorney, Agent, or Firm* — Calfee Halter & Griswold LLP

(57) ABSTRACT

Straightening device for long or rod-shaped metal products, comprising an upper roll unit and a lower roll unit, wherein the upper roll unit is mobile and can be positioned vertically at least in the step where a passage gap of said products is set to a desired value, wherein a hydraulic safety/control device is associated with the lower roll unit and comprises a single-effect hydraulic actuator of the selectively yielding type when an overload condition higher than a predetermined value is detected on said lower roll unit.

7 Claims, 4 Drawing Sheets

(51) Int. Cl.
*B21D 55/00* (2006.01)
*B21B 31/32* (2006.01)

(58) Field of Classification Search
CPC . B21B 2015/0071; B21B 19/02; B21B 19/04; B21B 19/06; B21B 31/16; B21B 31/20; B21B 33/00; B21B 37/58; B21B 37/62; B21B 38/08; B21B 38/10; B21B 2203/182; B21B 2203/38; B21B 2265/12; B21B 2271/02
USPC ... 72/10.6–10.8, 13.3, 13.4, 14.1, 14.3–14.5, 72/28.1, 28.2, 29.1, 29.2, 31.01, 31.02, 72/31.07, 98, 99, 160, 162, 164, 237, 72/238, 240, 241.6, 245, 246, 248, 432, 72/465.1, 466.3, 466.7
See application file for complete search history.

(56) References Cited

U.S. PATENT DOCUMENTS 3,933,018 A 1/1976 Fangmeier et al.
4,763,504 A 8/1988 Nilsson
5,142,892 A * 9/1992 Noe ..... B21B 31/32 72/19.9

OTHER PUBLICATIONS

International Preliminary Report on Patentability from PCT/IB2012/001356 dated Dec. 19, 2013.

* cited by examiner

STRAIGHTENING DEVICE WITH HYPERBOLIC ROLLS FOR METAL PRODUCTS AND CORRESPONDING METHOD

CROSS-REFERENCE TO RELATED APPLICATION

This application is the U.S. national phase entry of PCT/IB2012/001356, with an international filing date of 10 Jul. 2012, which claims the benefit of Italian Application Serial No. UD2011A000108, with a filing date of 11 Jul. 2011, the entire disclosures of which are fully incorporated herein by reference.

FIELD OF THE INVENTION

The present invention concerns a straightening device with hyperbolic rolls for metal products, and the corresponding method.

The invention is applied particularly, but not exclusively, on long metal products such as round pieces, bars or tubes exiting from a working line.

In particular, the straightening device according to the present invention is used on long metal products having a diameter comprised between 5 and 250 mm, to confer on them the desired definitive dimensional tolerances.

BACKGROUND OF THE INVENTION

In the field of working metal products, in particular long or rod-shaped metal products, it is known to provide a final pass in a so-called straightening machine, which has the function of conferring the definitive dimensional tolerances on the products.

It is widely known in the field to use straightening machines equipped with hyperbolic rolls, that is, opposite rolls mounted obliquely with respect to each other, with the purpose of conferring on the metal product in transit between them a roto-translational movement which determines both an advance and a rotation on their axis.

The passage gap defined between the two rolls can generally be adjusted depending on the size of the product being worked.

Generally, known straightening machines also have a safety/control device used to protect the integrity and the functioning of the machine if conditions of overload occur due to the fact that the products entering the machine have excessive sizes with respect to the measurements for which the machine has been set.

Overload conditions occur when a pressure is applied on a roll which is higher than the maximum established; this occurs, for example, if the products are over-sized, or particularly oval shaped, and therefore need a bigger gap than the one between the two rolls.

Known straightening machines can be grouped into two main classes: the first provides that both rolls, both the upper and the lower one, are mobile and can be moved vertically for the initial setting of the correct passage gap for the product to be worked. The second class, on the other hand, provides that only the upper roll is moved vertically, while the lower roll is fixed.

In the case of straightening machines belonging to the first class, the safety/control device is positioned on both the rolls so that, if it is activated, it determines the movement of both rolls. An example of this type of straightening machine is described in DE19724300, in which both rolls have a hydraulic system which serves both to define the initial gap and also to control the overload.

For straightening machines belonging to the second class, the safety/control device is positioned only on the upper roll, as it is the only one which can move.

In this case, the upper roll is not only adjusted mechanically or hydraulically, but also is supplied with a hydraulic system to maintain the force that develops between the roll and the product below a determinate value, beyond which the hydraulic system determines the lifting of the roll.

In known straightening machines, the movement of one or both rolls is obtained by using one or more hydraulic cylinders, which can be either double effect or single effect, or a combination of both.

One disadvantage of known straightening machines with hyperbolic rolls belonging to the first class is that both the movement unit and the control/safety device, positioned on both rolls, are complex to produce and manage.

Another disadvantage shared by straightening machines of both the first and second class is that the movement of the upper roll, if the control/safety device is activated, entails using a great force to lift it (the weight of one of these rolls varies from a few hundred kilograms to some tonnes, depending on the size of the machine). This determines a rather long reaction time, much longer than should be necessary to respond adequately to a situation of potential damage to the machine.

Another disadvantage is that, during maintenance of the control/safety device and of the upper roll, it is necessary to work at some meters from the ground, and also to use movement means such as cranes or gantries, to free the access to the individual parts of the machine; this entails considerable costs and working times.

U.S. Pat. No. 4,763,504 A describes a straightening machine with hyperbolic rolls in which there is an adjustment and safety device against overloads, associated to a lower roll. The device comprises an adjustment screw supported by a hollow piston that is kept in a normal position by a fixed holding element. The hollow piston supports the adjustment screw in correspondence with a surface that yields together with the piston when the pressure applied to the roll exceeds a determinate value.

One purpose of the present invention is to simplify the general construction of the device, its operating management, and all those operations to maintain and replace the parts and to ensure safety for the operators, thus allowing a considerable saving in both time and equipment, and hence entailing a considerable advantage from an economic point of view.

Another purpose of the present invention is to obtain a straightening machine of the type with hyperbolic rolls having limited reaction times when the control/safety device is activated in the event of overloads on the rolls or other operating disadvantage.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a straightening device according to the present invention comprises an upper roll unit and a lower roll unit, in which the upper roll unit is mobile and can be positioned vertically in the step when the passage gap is set to a desired value.

According to one feature of the present invention, the lower roll unit is associated to a hydraulic safety/control device comprising a single-effect hydraulic actuator of the type which selectively yields when the pressure acting on the lower roll unit exceeds a predetermined value.

In other words, the hydraulic actuator comprises a single-effect hydraulic actuator, or hydraulic bearing, associated to means to detect the position and/or the pressure.

At the moment when the means to detect the position and/or the pressure respectively detect a downward movement of the lower roll which is beyond a determinate allowed tolerance value, and/or an increase in the hydraulic pressure beyond a determinate allowed tolerance value, a condition of probable overload is signaled, due for example to a product in transit that exceeds the pre-established dimensions beyond a determinate value.

This signal causes the valve means to open so that the hydraulic fluid which keeps the actuator in position is discharged, and the lower roll unit, due to its own weight, and due to the pressure of the product being worked, moves downward, thus safeguarding the machine from possible damage.

On the other hand, in the normal operating step, keeping the lower roll unit in the correct position is guaranteed by introducing the hydraulic fluid into the chamber of the actuator and maintaining a stable pressure of said fluid.

Therefore, with the present invention, the activation of the safety/control device is determined simply by opening valve means and exploiting the lower roll's own weight.

In this way, it is possible to use a single-effect hydraulic actuator which, in a normal operating step, has the function of positioning the lower roll and keeping it positioned in the correct operating position, while in the case of intervention it determines an immediate movement downward of the lower roll, safeguarding the operativeness of the machine.

Another advantage of the present invention is that the travel of the hydraulic actuator can be kept very limited, since it does not have the function of carrying out an adjustment in setting the size of the gap, but only reacts to a detected overload lowering the lower roll by a certain extent in order to prevent damage to the structure of the straightening machine.

In one form of embodiment of the invention, the delivery channel of the hydraulic fluid also acts as a discharge channel.

In another form of embodiment of the invention, the hydraulic actuator has a diameter which is much smaller, in the range of about half, than the width of the corresponding roll. This reduced size determines a reduced quantity of oil in the discharge step, and therefore reduced reaction times to respond to the detection of an overload.

BRIEF DESCRIPTION OF THE DRAWINGS

These and other characteristics of the present invention will become apparent from the following description of a preferential form of embodiment, given as a non-restrictive example with reference to the attached drawings wherein.

Figure 1:
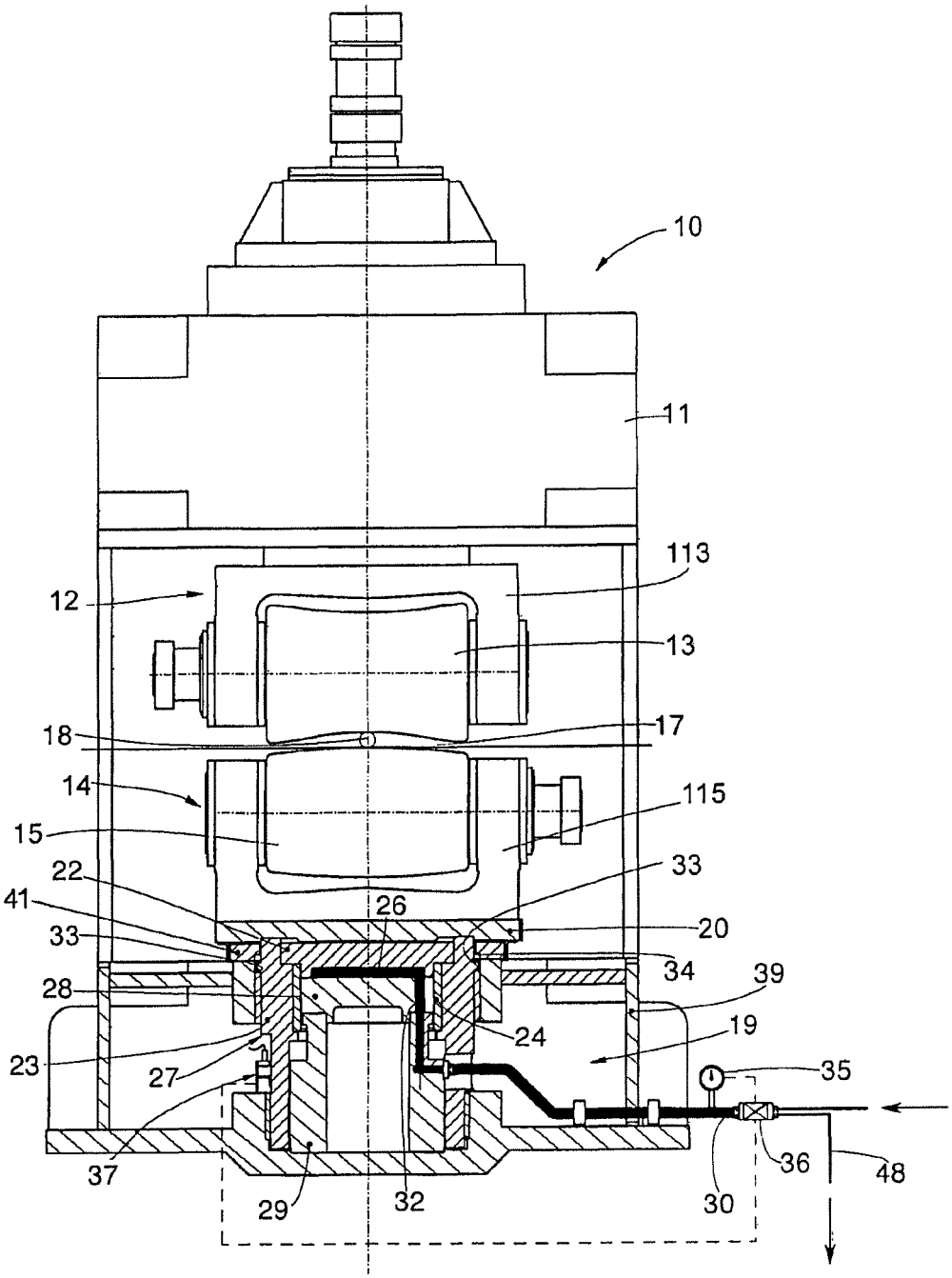
FIG. 1 shows a front view of a first form of embodiment of the straightening device according to the present invention.

To facilitate comprehension, the same reference numbers have been used, where possible, to identify identical common elements in the drawings. It is understood that elements and characteristics of one form of embodiment can conveniently be incorporated into other forms of embodiment without further clarifications.

DETAILED DESCRIPTION OF SOME PREFERENTIAL FORMS OF EMBODIMENT

Figure 3:
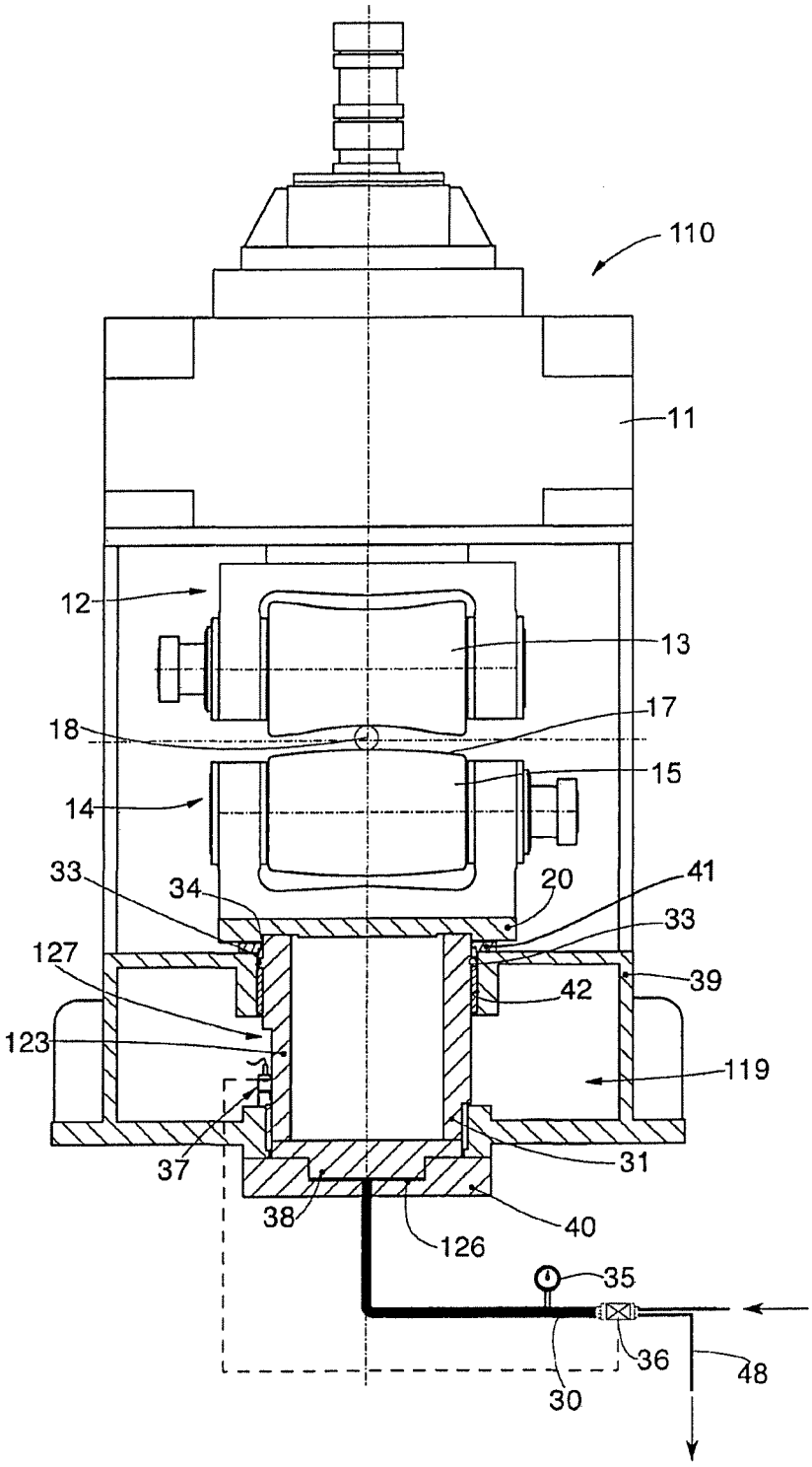
FIG. 3 shows a second form of embodiment of the straightening device according to the present invention.

A straightening device 10, 110 according to the present invention is shown in two forms of embodiment respectively in FIGS. 1 and 3.

The device 10, 110 comprises a bearing structure 11 to which an upper roll unit 12, having an upper roll 13 with a concave hyperbolic shape and a corresponding chock 113, and a lower roll unit 14 having a lower roll 15 of a convex hyperbolic shape and a corresponding chock 115 are connected. The roll units 12, 14 are disposed in an opposite position and define an intermediate space, or gap 17 with an adjustable value in which a long metal product 18 is made to transit, on which the definitive sizes which fall within required tolerances have to be conferred.

The upper roll unit 12, with the corresponding upper roll 13, is moved vertically, in the initial setting step, in both directions. The movement of the upper roll unit 12 can be carried out manually or automatically, preferably using a mechanical system, for example, with screws, cams, gears or other suitable means, which is not important for the purposes of the present invention.

Electric, hydrodynamic, mixed or other type systems can also be used.

The initial setting step of the nominal passage gap 17 of the product 18 is therefore carried out, moving the upper roll unit 12 with respect to the lower roll unit 14, kept in a maximum raised position, as will be explained in more detail heretofore.

The lower roll unit 14 is associated to a hydraulic actuator unit which, in the form of embodiment shown in FIG. 1, is indicated in its entirety by the reference number 19.

The hydraulic actuator unit 19 comprises a mobile part, or piston unit, generally indicated by the number 27, associated to the lower roll unit 14, and a fixed part, anchored to the bearing structure 11 or other fixed part, for example the base. The two parts are separated by a hydraulic chamber 26 which can be selectively filled with/emptied of hydraulic fluid fed by means of a conduit 30 along which a valve 36 is disposed, which can be activated as explained hereafter.

The mobile part 27 comprises, as its main components, a support 20 directly anchored to the lower roll unit 14, an intermediate sleeve 22 with a lower face directly in contact with the upper face of the chamber 26, a first metal tube 23 which contains said intermediate sleeve 22 and a second metal tube 24 inside the first metal tube 23.

The fixed part comprises a third support metal tube 29 and an upper covering plate 28, made of a material suitable to be in contact with oil, the upper face of which is directly in contact with the lower face of the chamber 26. The oil is introduced at high pressure through the hydraulic conduit 30 into the chamber 26, so as to progressively fill it, overcoming the force of the weight of the lower roll unit 14 and moving it upward.

Figure 2C:
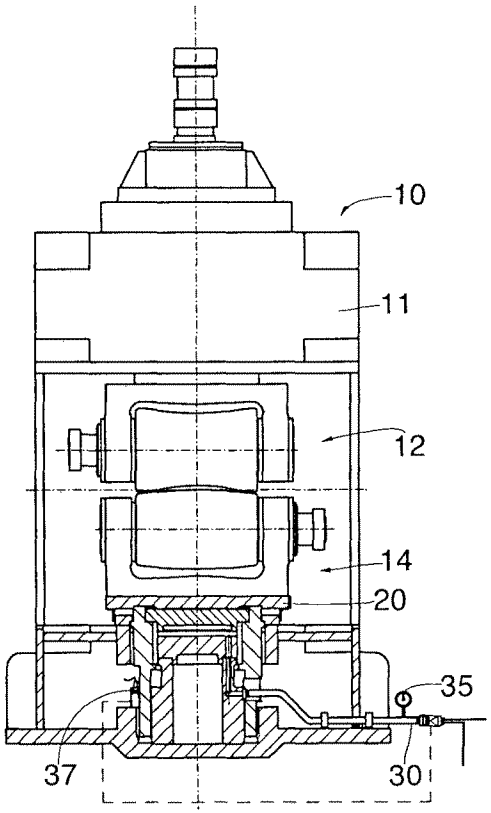
FIGS. 2*a*, 2*b*, 2*c* show an operating sequence of the functioning of the device in FIG. 1.
Figure 2B:
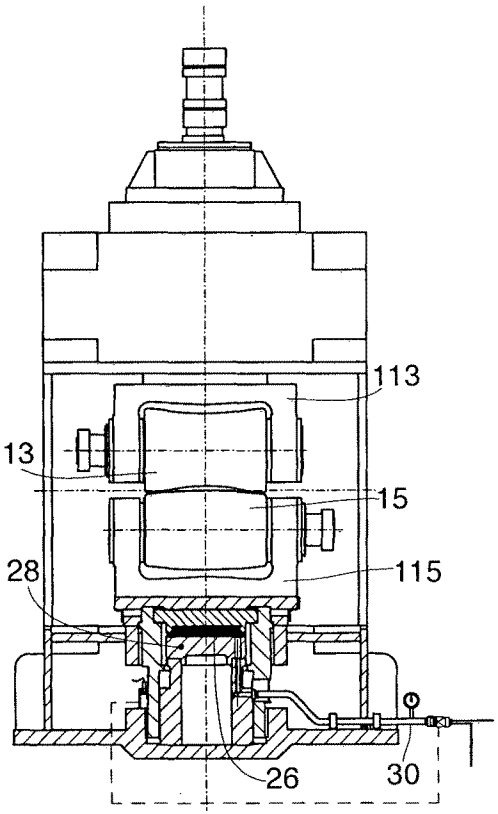
Figure 2A:
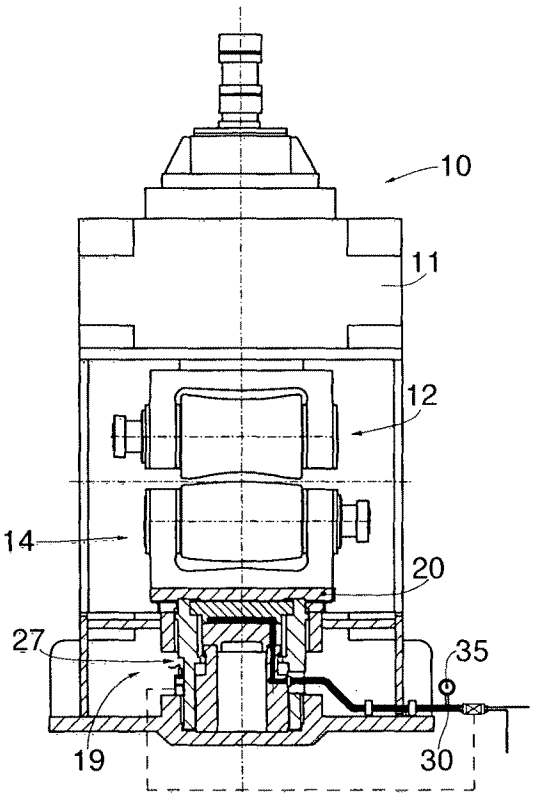

The upward movement of the upper roll unit 14 occurs progressively from a lowered position (FIG. 2*a*) to a maximum upward travel position (FIG. 2*b*), defined mechanically by the abutment between a tooth 33 protruding toward the outside of the first metal tube 23 and a fixed striker plate 41 defined above a cavity 34 into which the tooth 33 can move vertically. Having reached this position, the lower roll 15 is in its nominal operating position (FIG. 2*b*), with respect to which the adjustable position of the upper roll 13 defines gap value 17 set for the selected long product 18 to be worked.

In these conditions, the pressure of the oil inside the chamber 26 is about 100 bar, being able to reach a maximum value of about 130 bar.

In the case shown in FIG. 1, there is a pressure switch 35 on the delivery conduit 30, while there is a position detector 37 associated to the first metal tube 23.

During the normal functioning of the straightening device 10, the pressure switch 35 and the position detector 37 respectively detect the pressure of the hydraulic fluid in the chamber 26 and the position of the lower roll unit 14 with respect to the nominal position set.

If these values diverge from the pre-established tolerances with respect to the nominal values, that is, if the oil pressure exceeds a pre-established threshold, or the position of the lower roll unit 14 diverges excessively with respect to a defined tolerance, as a consequence of the passage of a product 18 with sizes outside tolerance levels, or are too oval, the pressure switch 35 and/or the position detector 37 send a command to open the valve 36.

When the valve 36 is opened, the oil is discharged from the chamber 26 through the same delivery conduit 30, and evacuated through a discharge line 48.

In this way, the pressure exerted by the product 18 being worked, together with the weight of the lower roll unit 14, determines the lowering of the entire lower roll unit 14, thus safeguarding the integrity of the machine.

The diameter of the hydraulic chamber 26 is less than the width of the straightening rolls 13 and 15 (between 0.45 and 0.75 times such width), in such a way that the quantity of oil to be discharged is rather low, so that the response times of the safety device thus made are advantageously low, keeping the pressure of the chamber within the established range.

The mobile part of the system, made up of support 20, sleeve 22, first metal tube 23 and second metal tube 24, is guided by the third metal support pipe 29 and by a containing element 39 solid to the structure 11, in this way guaranteeing stability and rigidness of the system.

The presence of the chamber 26 directly under the sleeve 22, and therefore under the lower roll 15, allows easy access from above for maintenance or interventions, also using the same mechanical system for moving the upper roll 13. Thanks to this, the use of a crane or other movement members can be avoided, at the same time guaranteeing greater safety, practicality and speed in operations to replace parts or in maintenance. Moreover, since access to the chamber 26 is from above, the present invention allows to avoid the construction of a pit, or other civil works, under the device, and also guarantees that the maintenance operations and replacement of parts can take place in safe, well-lit and comfortable conditions for the operators.

In the alternative form of embodiment shown in FIG. 3, in which the same reference numbers are used for equal or equivalent elements, the hydraulic actuator unit 119 comprises a mobile part consisting of the support 20 solid to the lower roll unit 14, and of a piston unit 127. The piston unit 127 in turn consists of a first metal tube 123 fixed at the lower part to a flange 38 and at the upper part to said support 20.

The fixed part of the hydraulic unit 119 instead consists of the containing element 39, solid to the structure 11, the lateral walls of which, in the contact zones indicated by the number 42, act as a guide for the first metal tube 123 of the piston unit 127, and of a lower flange 40, which makes up the bottom of the hydraulic unit 119 and is solid to said containing element 39.

A chamber 126 is created between the flange 38 (that is, the bottom of the mobile part of the hydraulic unit 119) and the flange 40 (that is, the bottom of the fixed part of the hydraulic unit 119), said chamber 126 being hydraulically connected to the oil delivery conduit 30 through a passage made in the lower flange 40. In particular, the upper face of the chamber 126 is directly in contact with the lower face of the flange 38, while the lower face of the chamber 126 is directly in contact with an upper face of the flange 40.

Figure 4C:
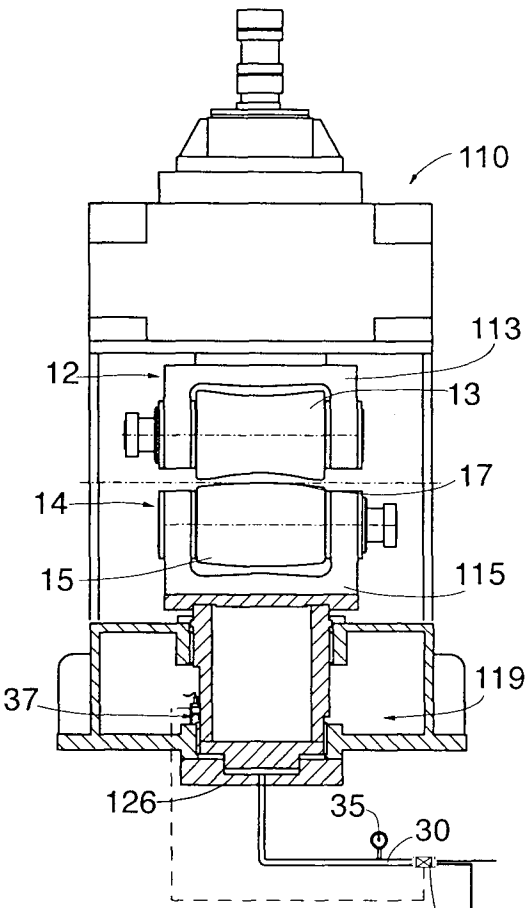
FIGS. 4*a*, 4*b*, 4*c* show an operating sequence of the functioning of the device in FIG. 3.
Figure 4B:
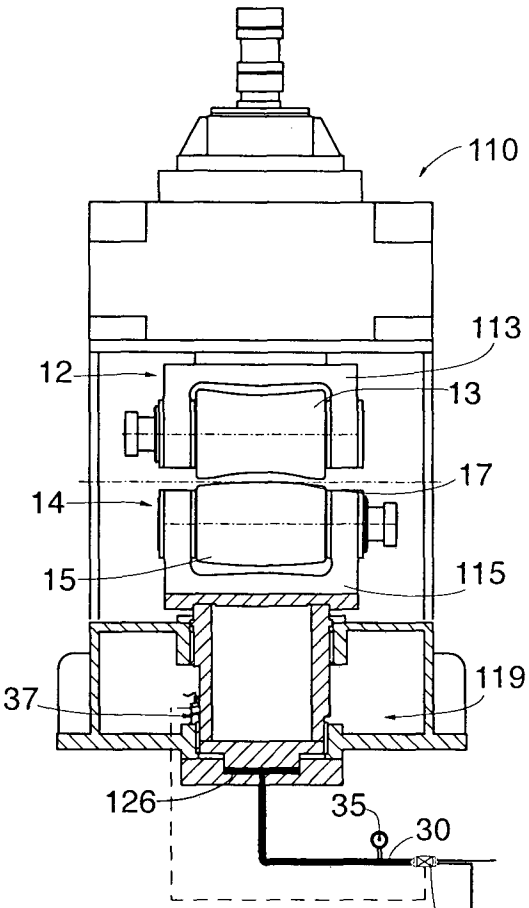
Figure 4A:
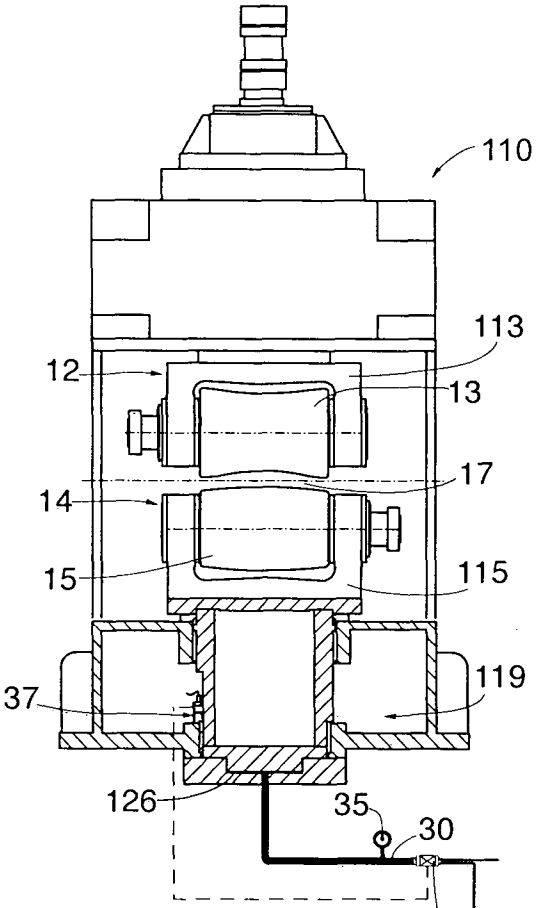

Similarly to what we saw before, an oil delivery system can introduce oil into the chamber 126, subject to the opening of the valve, in order to progressively raise the lower roll unit 14 (FIG. 4*a*), until the chamber 126 is completely full, taking the lower roll unit 14 to its stable, maximum raised operating position (FIG. 4*b*), defined by the mechanical abutment of the tooth 33 which slides into the cavity 34.

The position of the upper roll unit 13 with respect to the lower roll unit 14 can be adjusted mechanically, as already seen, to define the value of the nominal passage gap for the product 18 being worked.

In this case too, a pressure switch 35 and a position detector 37 are provided to respectively detect the pressure of the oil in the chamber 126 and the position of the lower roll unit 14 during working.

When the pressure switch 35 and/or the position detector 37 detect a variation in pressure or position which exceeds an allowed tolerance value, the valve 36 is opened to discharge the oil toward the discharge line 48.

The discharging of the oil determines an immediate lowering of the lower roll unit, due both to its own weight and also to the pressure which the product 18 being worked exerts on it, thus safeguarding the structural integrity of the machine.

From the description of the two forms of embodiment of the present invention, it can be seen that the invention allows to obtain a plurality of advantages in terms of operative, constructive and functioning simplicity.

The use of a single-effect actuator rather than a double-effect one makes the whole structure simpler and the response more rapid in the case of overloads.

Using the weight of the roll itself to obtain the lowering thereof facilitates operations and reduces the force needed to move it.

The entire hydraulic circuit is reduced to a single delivery conduit and a valve which can be selectively opened and closed.

The upper roll is moved and adjusted mechanically only during the initial setting step, then it is no longer involved in the activation of the safety/control device.

Finally, the maintenance operations on the hydraulic unit 19, 119 are also easier, given that the hydraulic bearing is at a man's height, therefore easily reached, and not situated at an even greater height with respect to the upper roll unit 12. In particular, in the case of the hydraulic unit 19, it is possible to act from above after having removed only the lower roll unit 14 and having used the mechanical adjustment system of the upper roll unit 12 to remove the support 20 and the sleeve 22.

It is clear that modifications and/or additions of parts may be made to the straightening device 10, 110 as described heretofore, without departing from the field and scope of the present invention.

The invention claimed is:

1. A straightening device for long or rod-shaped metal products, comprising a bearing structure, a vertically movable lower roll unit within the beating structure, a vertically movable upper roll unit above the lower roll unit and within the bearing structure, a safety and control device configured to detect the overload condition of the lower roll unit, and a hydraulic device under the lower roll unit, comprising a fixed part coupled to the bearing structure, a mobile part having a support, wherein the support is coupled to the lower roll unit, a fixed striker plate disposed between the fixed part and the lower roll unit, and a chamber flexibly formed by an upper face of the fixed part and a bottom face of the mobile part and capable of being selectively filled and emptied, wherein the fixed part and the striker plate define a cavity at an outside of the mobile part, the mobile part includes an abutment tooth disposed outside the chamber, wherein the abutment tooth is vertically moveable within the cavity to contact the striker plate to limit the maximum raised position of the chamber during filling and to stabilize the lower roll unit at its maximum raised operating position during normal operation of the straightening device, wherein the hydraulic device is a single-effect hydraulic actuator that is functionally associated with the safety and control device, wherein the lower roll unit is only vertically movable by the hydraulic device.

2. The straightening device of claim 1, wherein the safety and control device comprises detection means to detect position and pressure.

3. The straightening device of claim 2, wherein the detection means are configured to generate a signal to activate the hydraulic device in order to determine the lowering of the lower roll unit.

4. The straightening device of claim 1, wherein the hydraulic device further comprises a conduit connecting to the chamber, wherein the conduit is configured to feed and discharge the hydraulic fluid.

5. The straightening device of claim 4, wherein the hydraulic device further comprises valve means on the conduit, the valve means are functionally associated with the detection means so as to determine selective discharge of the hydraulic fluid from the chamber at the moment in which the detection means detects an overload condition on the lower roll unit.

6. The straightening device of claim 1, wherein a diameter of the hydraulic device is less than the length of the lower roll unit.

7. The straightening device of claim 6, wherein the diameter of the hydraulic device is about half of the length of the lower roll unit.

* * * * *